US011056764B2

(12) United States Patent
Rofougaran et al.

(10) Patent No.: US 11,056,764 B2
(45) **Date of Patent: *Jul. 6, 2021**

(54) PHASED ARRAY ANTENNA PANEL HAVING REDUCED PASSIVE LOSS OF RECEIVED SIGNALS

(71) Applicant: Movandi Corporation, Newport Beach, CA (US)

(72) Inventors: Ahmadreza Rofougaran, Newport Beach, CA (US); Seunghwan Yoon, Irvine, CA (US); Alfred Grau Besoli, Irvine, CA (US); Farid Shirinfar, Granada Hills, CA (US); Sam Gharavi, Irvine, CA (US); Michael Boers, South Turramurra (AU); Maryam Rofougaran, Rancho Palos Verdes, CA (US)

(73) Assignee: SILICON VALLEY BANK, Santa Clara, CA (US)

( * ) Notice: Subject to any disclaimer, the term of this patent is extended or adjusted under 35 U.S.C. 154(b) by 185 days.

This patent is subject to a terminal disclaimer.

(21) Appl. No.: 16/204,397

(22) Filed: Nov. 29, 2018

(65) Prior Publication Data

US 2019/0097305 A1 Mar. 28, 2019

Related U.S. Application Data

(63) Continuation of application No. 15/356,172, filed on Nov. 18, 2016, now Pat. No. 10,199,717.

(51) Int. Cl.
*H01Q 1/22* (2006.01)
*H01Q 1/52* (2006.01)
(Continued)

(52) U.S. Cl.
CPC ..... *H01Q 1/2283* (2013.01); *H01Q 1/523* (2013.01); *H01Q 21/065* (2013.01); *H01Q 21/24* (2013.01);
(Continued)

(58) Field of Classification Search
CPC .... H01Q 1/2283; H01Q 1/523; H01Q 21/065; H01Q 21/24; H01Q 3/26; H01Q 21/0006; H01Q 25/001
See application file for complete search history.

(56) References Cited

U.S. PATENT DOCUMENTS 2,579,324 A 12/1951 Kock
2,652,189 A 9/1953 Gorman
(Continued)

FOREIGN PATENT DOCUMENTS

WO 2008027531 A3 12/2008

OTHER PUBLICATIONS

Corrected Notice of Allowability for U.S. Appl. No. 15/256,222 dated Jul. 10, 2020.
(Continued)

*Primary Examiner* — Dameon E Levi
*Assistant Examiner* — David E Lotter
(74) *Attorney, Agent, or Firm* — Chip Law Group

(57) ABSTRACT

A phased array antenna panel includes a first plurality of antennas, a first radio frequency (RF) front end chip, a second plurality of antennas, a second RF front end chip, and a combiner RF chip. The first and second RE front end chips receive respective first and second input signals from the first and second pluralities of antennas, and produce respective first and second output signals based on the respective first and second input signals. The combiner RF chip can receive the first and second output signals and produce a power combined output signal that is a combination of
(Continued)

powers of the first and second output signals. Alternatively, a power combiner can receive the first and second output signals and produce a power combined output signal, and the combiner RF chip can receive the power combined output signal.

16 Claims, 8 Drawing Sheets

(51) Int. Cl.

| | |
|---|---|
| ***H01Q 21/06*** | (2006.01) |
| ***H01Q 21/24*** | (2006.01) |
| *H01Q 3/26* | (2006.01) |
| *H01Q 21/00* | (2006.01) |
| *H01Q 25/00* | (2006.01) |

(52) U.S. Cl.
CPC ..... *H01Q 3/26* (2013.01); *H01Q 21/0006* (2013.01); *H01Q 25/001* (2013.01)

(56) References Cited

U.S. PATENT DOCUMENTS 3,835,469 A 9/1974 Chen et al.
3,836,973 A 9/1974 Shnitkin et al.
4,380,013 A 4/1983 Slysh
4,739,334 A 4/1988 Soref
4,799,062 A 1/1989 Sanderford et al.
4,827,276 A 5/1989 Fukuzawa et al.
4,829,314 A 5/1989 Barbier et al.
5,479,651 A 12/1995 Nakaguchi
5,883,602 A 3/1999 Volman
5,936,577 A 8/1999 Shoki et al.
5,936,588 A 8/1999 Rao et al.
6,297,774 B1 10/2001 Chung
6,307,502 B1 10/2001 Marti-Canales et al.
6,307,507 B1 10/2001 Gross et al.
6,678,430 B1 1/2004 Noe et al.
6,808,237 B2 10/2004 Schmid et al.
6,891,511 B1 5/2005 Angelucci
6,911,956 B2 6/2005 Miyata
7,170,442 B2 1/2007 Lovberg et al.
7,480,486 B1 1/2009 Oh et al.
7,664,193 B2 2/2010 Jalali et al.
7,982,555 B2 7/2011 Rofougaran
8,045,638 B2 10/2011 Grant et al.
8,274,443 B2 9/2012 Hauhe et al.
8,482,462 B2 7/2013 Komijani et al.
8,589,003 B2 11/2013 Brand et al.
8,618,983 B2 12/2013 Chen et al.
9,277,510 B2 3/2016 Helmersson et al.
9,537,214 B2 1/2017 Gorman et al.
9,638,795 B2 5/2017 Ahmed
9,692,489 B1 6/2017 Rofougaran et al.
9,722,322 B2 8/2017 Bertin et al.
9,819,410 B1 11/2017 Azevedo et al.
10,090,887 B1 10/2018 Rofougaran et al.
10,103,853 B2 10/2018 Moshfeghi
10,199,717 B2 * 2/2019 Rofougaran ..... H01Q 1/523
10,277,370 B2 4/2019 Moshfeghi
10,320,090 B2 6/2019 Zou et al.
10,355,720 B2 7/2019 Shattil
10,666,326 B2 5/2020 Rofougaran et al.
2002/0165001 A1 11/2002 Phillips et al.
2003/0122724 A1 7/2003 Shelley et al.
2004/0077379 A1 4/2004 Smith et al.
2004/0080455 A1 4/2004 Lee
2004/0082356 A1 4/2004 Walton et al.
2004/0196184 A1 10/2004 Hollander et al.
2004/0204114 A1 10/2004 Brennan et al.
2005/0205720 A1 9/2005 Peltz et al.
2006/0128336 A1 6/2006 Waltman et al.
2006/0205342 A1 9/2006 McKay et al.
2006/0273959 A1 12/2006 Kawasaki
2007/0115800 A1 5/2007 Fonseka et al.
2007/0127360 A1 6/2007 Song et al.
2007/0160014 A1 7/2007 Larsson
2008/0026763 A1 1/2008 Rensburg et al.
2008/0100504 A1 5/2008 Martin et al.
2008/0163693 A1 7/2008 Sfez et al.
2008/0303701 A1 12/2008 Zhang et al.
2009/0010215 A1 1/2009 Kim et al.
2009/0092120 A1 4/2009 Goto et al.
2009/0136227 A1 5/2009 Lambert
2009/0156227 A1 6/2009 Frerking et al.
2009/0175214 A1 7/2009 Sfar et al.
2009/0191910 A1 7/2009 Athalye et al.
2009/0195455 A1 8/2009 Kim et al.
2009/0296846 A1 12/2009 Maru
2010/0046655 A1 2/2010 Lee et al.
2010/0090898 A1 4/2010 Gallagher et al.
2010/0149039 A1 6/2010 Komijani et al.
2010/0261440 A1 10/2010 Corman et al.
2010/0265925 A1 10/2010 Liu et al.
2010/0266061 A1 10/2010 Cheng et al.
2010/0267415 A1 10/2010 Kakitsu et al.
2010/0284446 A1 11/2010 Mu et al.
2011/0025432 A1 2/2011 Gagnon et al.
2011/0149835 A1 6/2011 Shimada et al.
2011/0291891 A1 12/2011 Nsenga et al.
2012/0143407 A1 6/2012 Murthy
2012/0149300 A1 6/2012 Forster
2012/0224651 A1 9/2012 Murakami et al.
2012/0272857 A1 11/2012 Graab et al.
2013/0023210 A1 1/2013 Rofougaran
2013/0039342 A1 2/2013 Kazmi
2013/0069831 A1 3/2013 Friedman et al.
2013/0072112 A1 3/2013 Gunnarsson et al.
2013/0072113 A1 3/2013 Lee et al.
2013/0088393 A1 4/2013 Lee et al.
2013/0173094 A1 7/2013 Cooper et al.
2013/0208608 A1 8/2013 Piazza et al.
2014/0009347 A1 1/2014 Bertin et al.
2014/0022109 A1 1/2014 Lee et al.
2014/0035731 A1 2/2014 Chan et al.
2014/0035780 A1 2/2014 Trotta
2014/0077875 A1 3/2014 Wang et al.
2014/0079165 A1 3/2014 Kludt et al.
2014/0104124 A1 4/2014 Chernokalov et al.
2014/0125539 A1 5/2014 Katipally et al.
2014/0129060 A1 5/2014 Cooper et al.
2014/0161018 A1 6/2014 Chang et al.
2014/0184439 A1 7/2014 Ainspan et al.
2014/0191905 A1 7/2014 Kamgaing
2014/0210668 A1 * 7/2014 Wang ..... H04B 7/0617 342/372
2014/0266866 A1 9/2014 Swirhun et al.
2015/0015449 A1 1/2015 Jecko et al.
2015/0129668 A1 5/2015 Kam et al.
2015/0296344 A1 10/2015 Trojer et al.
2015/0324683 A1 11/2015 Linfield
2015/0341098 A1 11/2015 Angeletti et al.
2016/0141248 A1 5/2016 Pueschner et al.
2016/0240919 A1 8/2016 Wu et al.
2017/0054216 A1 2/2017 Shi et al.
2017/0062944 A1 3/2017 Zimmerman et al.
2017/0264014 A1 9/2017 Le-Ngoc
2017/0332249 A1 11/2017 Guey et al.
2017/0353338 A1 12/2017 Amadjikpe et al.
2018/0027471 A1 1/2018 Zhang et al.
2018/0063139 A1 3/2018 Day et al.
2018/0109303 A1 4/2018 Yoo et al.
2018/0176799 A1 6/2018 Lange et al.
2018/0183152 A1 6/2018 Turpin et al.
2019/0123866 A1 4/2019 Moshfeghi
2019/0319754 A1 10/2019 Moshfeghi
2019/0319755 A1 10/2019 Moshfeghi
2019/0319756 A1 10/2019 Moshfeghi
2020/0076491 A1 3/2020 Zhang et al.
2020/0145079 A1 5/2020 Marinier et al.
2020/0204249 A1 6/2020 Pyun
2020/0412519 A1 12/2020 Krishnaswamy et al.

(56) References Cited

U.S. PATENT DOCUMENTS

OTHER PUBLICATIONS

Corrected Notice of Allowability for U.S. Appl. No. 16/377,980 dated Jul. 22, 2020.
Corrected Notice of Allowability for U.S. Appl. No. 16/526,544 dated Jul. 16, 2020.
Corrected Notice of Allowance for U.S. Appl. No. 16/526,544 dated May 13, 2020.
Corrected Notice of Allowance for U.S. Appl. No. 15/836,198 dated May 22, 2020.
Corrected Notice of Allowance for U.S. Appl. No. 16/294,025 dated May 18, 2020.
Final Office Action for U.S. Appl. No. 15/256,222 dated Oct. 4, 2019.
Final Office Action for U.S. Appl. No. 16/125,757 dated Jul. 15, 2020.
Final Office Action for U.S. Appl. No. 16/377,847 dated Jul. 13, 2020.
Final Office Action for U.S. Appl. No. 16/666,680 dated Jun. 29, 2020.
Non-Final Office Action for U.S. Appl. No. 15/256,222 dated Aug. 27, 2018.
Non-Final Office Action for U.S. Appl. No. 15/256,222 dated Mar. 21, 2019.
Non-Final Office Action for U.S. Appl. No. 16/153,735 dated May 13, 2020.
Non-Final Office Action for U.S. Appl. No. 16/388,043 dated Aug. 3, 2020.
Non-Final Office Action for U.S. Appl. No. 16/819,388 dated Jul. 2, 2020.
Notice of Allowance for U.S. Appl. No. 15/256,222 dated Apr. 3, 2020.
Notice of Allowance for U.S. Appl. No. 15/607,750 dated Jun. 1, 2020.
Notice of Allowance for U.S. Appl. No. 16/129,413 dated Aug. 12, 2020.
Notice of Allowance for U.S. Appl. No. 16/153,735 dated Jul. 2, 2020.
Notice of Allowance for U.S. Appl. No. 16/684,789 dated Jul. 10, 2020.
Supplemental Notice of Allowability for U.S. Appl. No. 16/153,735 dated Jul. 22, 2020.
Supplemental Notice of Allowance for U.S. Appl. No. 16/231,903 dated Jul. 1, 2020.
Abbaspour-Tamijani et al., "Enhancing the Directivity of Phased Array Antennas Using Lens-Arrays," Progress in Electromagnetics Research M, vol. 29, 2013. pp. 41-64.
Advisory Action in U.S. Appl. No. 15/724,638 dated May 25, 2018.
Baggett, Benjamin M.W. Optimization of Aperiodically Spaced Phased Arrays for Wideband Applications. MS Thesis. Virginia Polytechnic Institute and State University, 2011. pp. 1-137.
Final Office Action in U.S. Appl. No. 15/724,638 dated Mar. 14, 2018.
Final Office Action in U.S. Appl. No. 14/488,355 dated Mar. 4, 2016.
Imbert et al., "Design and Performance Evaluation of a Dielectric Flat Lens Antenna for Millimeter-Wave Applications," IEEE Antennas and Wireless Propagation Letters, vol. 14, 2015. pp. 1-4.
International Search Report and Written Opinion in PCT/US2014/055984 dated Jun 18, 2015, pp. 1-12.
Non-Final Office Action in U.S. Appl. No. 14/488,355 dated Nov. 13, 2015.
Non-Final Office Action in U.S. Appl. No. 15/225,071 dated Aug. 21, 2017.
Non-Final Office Action in U.S. Appl. No. 15/278,970 dated Jan. 3, 2018.
Non-Final Office Action in U.S. Appl. No. 15/279,171 dated Apr. 24, 2018.
Non-Final Office Action in U.S. Appl. No. 15/279,219 dated Dec. 27, 2017.
Non-Final Office Action in U.S. Appl. No. 15/335,034 dated Apr. 6, 2018.
Non-Final Office Action in U.S. Appl. No. 15/356,172 dated Mar. 14, 2018.
Non-Final Office Action in U.S. Appl. No. 15/432,018 dated Nov. 6, 2017.
Non-Final Office Action in U.S. Appl. No. 15/432,018 dated Sep. 25, 2018.
Non-Final Office Action in U.S. Appl. No. 15/432,091 dated Nov. 22, 2017.
Non-Final Office Action in U.S. Appl. No. 15/432,185 dated Dec. 5, 2017.
Non-Final Office Action in U.S. Appl. No. 15/600,443 dated Dec. 27, 2017.
Non-Final Office Action in U.S. Appl. No. 15/640,174 dated Jun. 8, 2018.
Non-Final Office Action in U.S. Appl. No. 15/724,638 dated Nov. 6, 2017.
Notice of Allowance in U.S. Appl. No. 14/488,355 dated Jun. 8, 2016.
Notice of Allowance in U.S. Appl. No. 15/225,071 dated Nov. 22, 2017.
Notice of Allowance in U.S. Appl. No. 15/255,656 dated Apr. 10, 2018.
Notice of Allowance in U.S. Appl. No. 15/256,038 dated Apr. 19, 2017.
Notice of Allowance in U.S. Appl. No. 15/356,172 dated Sep. 26, 2018.
Notice of Allowance in U.S. Appl. No. 15/432,091 dated Apr. 11, 2018.
Notice of Allowance in U.S. Appl. No. 15/432,185 dated Sep. 12, 2018.
Notice of Allowance in U.S. Appl. No. 15/724,638 dated Jul. 19, 2018.
Restriction Requirement in U.S. Appl. No. 15/279,171 dated Dec. 21, 2017.
Corrected Notice of Allowance for U.S. Appl. No. 16/526,544 dated Aug. 25, 2020.
Corrected Notice of Allowance for U.S. Appl. No. 15/256,222 dated Oct. 28, 2020.
Corrected Notice of Allowance for U.S. Appl. No. 15/836,198 dated Oct. 2, 2020.
Corrected Notice of Allowance for U.S. Appl. No. 16/153,735 dated Nov. 18, 2020.
Corrected Notice of Allowance for U.S. Appl. No. 16/377,980 dated Oct. 5, 2020.
Corrected Notice of Allowance for U.S. Appl. No. 16/526,544 dated Sep. 25, 2020.
Corrected Notice of Allowance for U.S. Appl. No. 16/684,789 dated Nov. 20, 2020.
Final Office Action for U.S. Appl. No. 16/364,956 dated Oct. 2, 2020.
Non-Final Office Action for U.S. Appl. No. 16/233,044 dated Oct. 14, 2020.
Non-Final Office Action for U.S. Appl. No. 16/398,156 dated Oct. 15, 2020.
Non-Final Office Action for U.S. Appl. No. 16/451,998 dated Sep. 11, 2020.
Non-Final Office Action for U.S. Appl. No. 16/452,023 dated Sep. 9, 2020.
Non-Final Office Action for U.S. Appl. No. 16/461,980 dated Sep. 21, 2020.
Non-Final Office Action for U.S. Appl. No. 16/666,680 dated Nov. 13, 2020.
Non-Final Office Action for U.S. Appl. No. 16/689,758 dated Sep. 29, 2020.
Non-Final Office Action for U.S. Appl. No. 16/866,536 dated Sep. 1, 2020.
Non-Final Office Action for U.S. Appl. No. 16/941,690 dated Nov. 12, 2020.

(56) References Cited

OTHER PUBLICATIONS

Notice of Allowability for U.S. Appl. No. 16/129,413 dated Nov. 9, 2020.
Notice of Allowance for U.S. Appl. No. 16/125,757 dated Oct. 28, 2020.
Notice of Allowance for U.S. Appl. No. 16/388,043 dated Nov. 5, 2020.
Notice of Allowance for U.S. Appl. No. 16/452,023 dated Nov. 16, 2020.
Supplemental Notice of Allowance for U.S. Appl. No. 16/153,735 dated Oct. 9, 2020.
Notice of Allowance for U.S. Appl. No. 16/927,470 dated Oct. 29, 2020.
Notice of Allowability for U.S. Appl. No. 16/129,413 dated Jan. 6, 2021.
Corrected Notice of Allowability for U.S. Appl. No. 16/684,789 dated Jan. 11, 2021.
Corrected Notice of Allowance for U.S. Appl. No. 16/125,757 dated Dec. 31, 2020.
Corrected Notice of Allowance for U.S. Appl. No. 16/125,757 dated Feb. 1, 2021.
Corrected Notice of Allowance for U.S. Appl. No. 16/129,413 dated Nov. 27, 2020.
Corrected Notice of Allowance for U.S. Appl. No. 16/364,956 dated Jan. 6, 2021.
Corrected Notice of Allowance for U.S. Appl. No. 16/388,043 dated Dec. 24, 2020.
Corrected Notice of Allowance for U.S. Appl. No. 16/388,043 dated Dec. 30, 2020.
Corrected Notice of Allowance for U.S. Appl. No. 16/675,290 dated Dec. 16, 2020.
Corrected Notice of Allowance for U.S. Appl. No. 16/927,470 dated Feb. 2, 2021.
Corrected Notice of Allowance for U.S. Appl. No. 16/927,470 dated Jan. 26, 2021.
Corrected Notice of Allowance for U.S. Appl. No. 16/388,043 dated Feb. 8, 2021.
International Preliminary Report on Patentability for International Application No. PCT/US2018/064184 dated Jan 21, 2021.
Morgan et al., "A Same-Frequency Cellular Repeater Using Adaptive Feedback Cancellation," IEEE, Mar. 12, 2012, pp. 3825-3830.
Non-Final Office Action for U.S. Appl. No. 16/377,847 dated Dec. 14, 2020.
Notice of Allowability for U.S. Appl. No. 15/607,750 dated Jan. 11, 2021.
Notice of Allowability for U.S. Appl. No. 16/129,413 dated Feb. 18, 2021.
Notice of Allowance for U.S. Appl. No. 16/354,390 dated Feb. 25, 2021.
Notice of Allowance for U.S. Appl. No. 16/364,956 dated Dec. 11, 2020.
Notice of Allowance for U.S. Appl. No. 16/451,998 dated Jan. 14, 2021.
Notice of Allowance for U.S. Appl. No. 16/689,758 dated Jan. 22, 2021.
Notice of Allowance for U.S. Appl. No. 16/819,388 dated Jan. 25, 2021.
Notice of Allowance for U.S. Appl. No. 16/866,536 dated Jan. 29, 2021.
Supplemental Notice of Allowability for U.S. Appl. No. 16/153,735 dated Jan. 11, 2021.
Supplemental Notice of Allowance for U.S. Appl. No. 16/452,023 dated Feb. 18, 2021.
Supplemental Notice of Allowance for U.S. Appl. No. 16/153,735 dated Feb. 24, 2021.
Corrected Notice of Allowability for U.S. Appl. No. 16/125,757 dated Mar. 11, 2021.
Corrected Notice of Allowance for U.S. Appl. No. 16/354,390 dated Apr. 9, 2021.
Corrected Notice of Allowance for U.S. Appl. No. 16/689,758 dated Apr. 7, 2021.
Non-Final Office Action for U.S. Appl. No. 17/011,042 dated Mar. 23, 2021.
Notice of Allowability for U.S. Appl. No. 16/388,043 dated Mar. 11, 2021.
Notice of Allowability for U.S. Appl. No. 16/819,388 dated Apr. 5, 2021.
Notice of Allowance for U.S. Appl. No. 16/377,847 dated Apr. 5, 2021.
Notice of Allowance for U.S. Appl. No. 16/391,628 dated Mar. 17, 2021.
Notice of Allowance for U.S. Appl. No. 16/451,980 dated Mar. 23, 2021.
Notice of Allowance for U.S. Appl. No. 16/666,680 dated Mar. 2, 2021.
Supplemental Notice of Allowance for U.S. Appl. No. 16/451,998 dated Mar. 2, 2021.
Supplemental Notice of Allowance for U.S. Appl. No. 16/866,536 dated Mar. 17, 2021.
Corrected Notice of Allowance for U.S. Appl. No. 16/364,956 dated May 6, 2021.
Corrected Notice of Allowance for U.S. Appl. No. 16/388,043 dated Apr. 15, 2021.
Corrected Notice of Allowance for U.S. Appl. No. 16/689,758 dated Apr. 29, 2021.
Corrected Notice of Allowance for U.S. Appl. No. 16/866,536 dated Apr. 29, 2021.
Corrected Notice of Allowance for U.S. Appl. No. 16/927,470 dated Apr. 26, 2021.
Final Office Action for U.S. Appl. No. 16/233,044 dated Apr. 19, 2021.
Final Office Action for U.S. Appl. No. 16/398,156 dated Apr. 19, 2021.
Notice of Allowability for U.S. Appl. No. 16/819,388 dated Apr. 28, 2021.
Notice of Allowance for U.S. Appl. No. 16/388,043 dated May 7, 2021.
Notice of Allowance for U.S. Appl. No. 16/941,690 dated May 5, 2021.
Supplemental Notice of Allowance for U.S. Appl. No. 16/451,980 dated May 18, 2021.
Supplemental Notice of Allowance for U.S. Appl. No. 16/451,998 dated May 18, 2021.
Supplemental Notice of Allowance for U.S. Appl. No. 16/452,023 dated Apr. 30, 2021.
Supplemental Notice of Allowance for U.S. Appl. No. 16/941,690 dated May 18, 2021.

* cited by examiner

PHASED ARRAY ANTENNA PANEL HAVING REDUCED PASSIVE LOSS OF RECEIVED SIGNALS

CROSS REFERENCE TO RELATED APPLICATION

This Patent Application is a Continuation Application of U.S. patent application Ser. No. 15/356,172, filed on Nov. 18, 2016. This application also makes reference to U.S. Pat. No. 9,923,712, filed on Aug. 1, 2016, titled "Wireless Receiver with Axial Ratio and Cross-Polarization Calibration," and U.S. patent application Ser. No. 15/225,523, filed on Aug. 1, 2016, titled "Wireless Receiver with Tracking Using Location, Heading, and Motion Sensors and Adaptive Power Detection," and U.S. patent application Ser. No. 15/226,785, filed on Aug. 2, 2016, titled "Large Scale Integration and Control of Antennas with Master Chip and Front End Chips on a Single Antenna Panel," and U.S. Pat. No. 10,014,567, filed on Sep. 2, 2016, titled "Novel Antenna Arrangements and Routing Configurations in Large Scale Integration of Antennas with Front End Chips in a Wireless Receiver," and U.S. Pat. No. 9,692,489 filed on Sep. 2, 2016, titled "Transceiver Using Novel Phased Array Antenna Panel for Concurrently Transmitting and Receiving Wireless Signals," and U.S. patent application Ser. No. 15/256,222 filed on Sep. 2, 2016, titled "Wireless Transceiver Having Receive Antennas and Transmit Antennas with Orthogonal Polarizations in a Phased Array Antenna Panel," and U.S. patent application Ser. No. 15/278,970 filed on Sep. 28, 2016, titled "Low-Cost and Low Loss Phased Array Antenna Panel," and U.S. patent application Ser. No. 15/279,171 filed on Sep. 28, 2016, titled "Phased Array Antenna Panel Having Cavities with RF Shields for Antenna Probes," and U.S. patent application Ser. No. 15/279,219 filed on Sep. 28, 2016, and titled "Phased Array Antenna Panel Having Quad Split Cavities Dedicated to Vertical-Polarization and Horizontal-Polarization Antenna Probes," and U.S. patent application Ser. No. 15/335,034 filed on Oct. 26, 2016, titled "Lens-Enhanced Phased Array Antenna Panel," and U.S. patent application Ser. No. 10/135,153 filed on Oct. 26, 2016, titled "Phased Array Antenna Panel with Configurable Slanted Antenna Rows," and U.S. patent application Ser. No. 15/355,967 filed on Nov. 18, 2016, titled "Phased Array Antenna Panel with Enhanced Isolation and Reduced Loss." Each of the aforementioned Patent Applications and Patents are hereby incorporated herein by reference in its entirety.

BACKGROUND

Phased array antenna panels with large numbers of antennas and front end chips integrated on a single board are being developed in view of higher wireless communication frequencies being used between a satellite transmitter and a wireless receiver, and also more recently in view of higher frequencies used in the evolving 5G wireless communications (5th generation mobile networks or 5th generation wireless systems). Phased array antenna panels are capable of beamforming by phase shifting and amplitude control techniques, and without physically changing direction or orientation of the phased array antenna panels, and without a need for mechanical parts to effect such changes in direction or orientation.

Phased array antenna panels use RF front end chips that directly interface with and collect RF signals from antennas situated adjacent to the RF front end chips. After processing the collected RF signals, the RF front end chips may provide the processed signals to a master chip that is situated relatively far from the RF front end chips. As such, relatively long transmission lines are required to carry the processed signals from the RF front end chips to the master chip. By their nature, transmission lines cause passive energy loss in the signals, especially when the transmission lines employed in the phased array antenna panel are long. Moreover, using a greater number or larger amplifiers in RF front end chips to transmit the processed signals to the master chip would increase the size, complexity, and cost of the numerous RF front end chips that are used in a phased array antenna panel. Thus, there is a need in the art for effective large-scale integration of a phased array antenna panel with reduced passive loss of signals.

SUMMARY

The present disclosure is directed to a phased array antenna panel having reduced passive loss of received signals, substantially as shown in and/or described in connection with at least one of the figures, and as set forth in the claims.

DETAILED DESCRIPTION

Figure 1A:
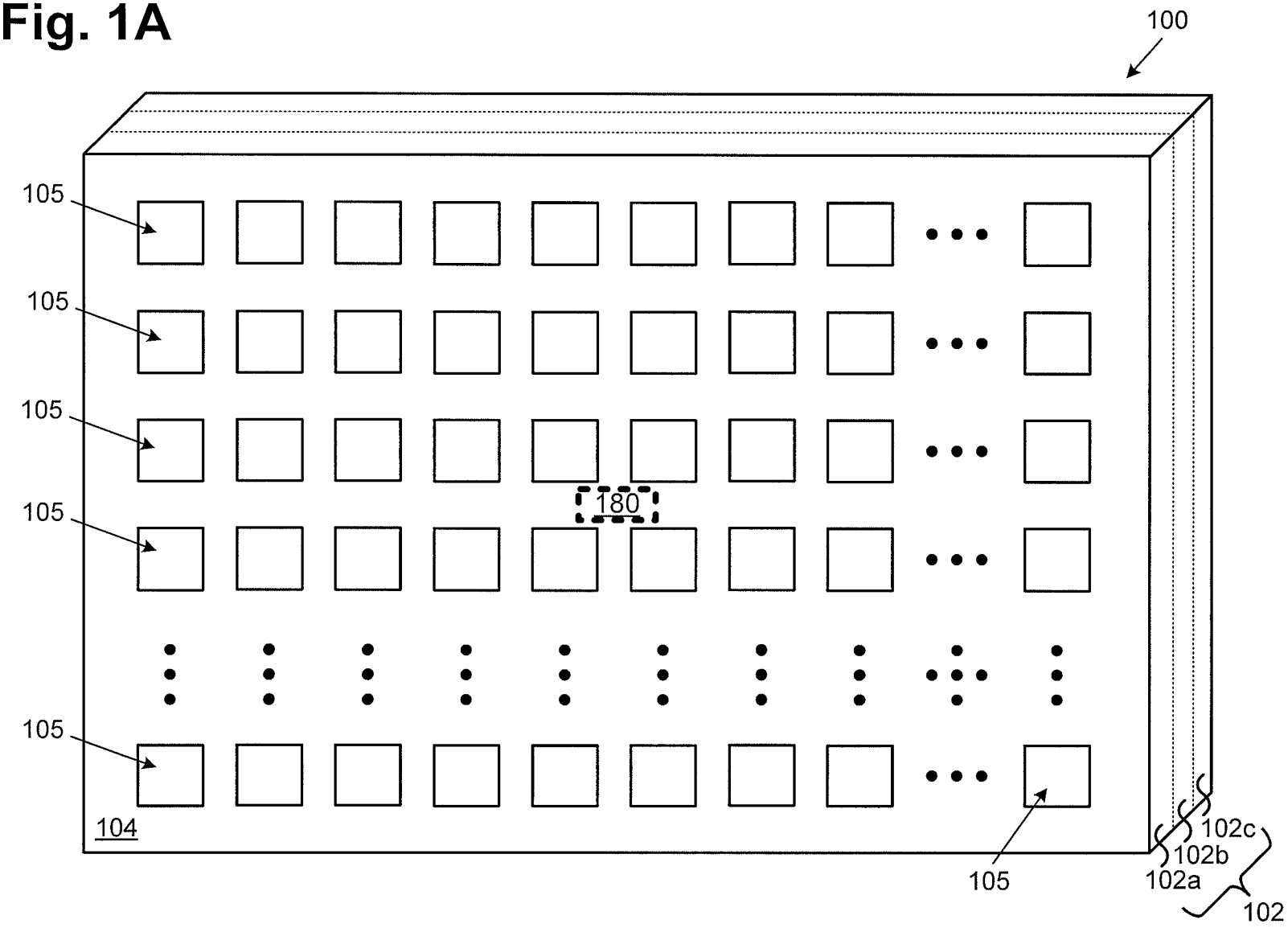
FIG. 1A illustrates a perspective view of a portion of an exemplary phased array antenna panel according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1A illustrates a perspective view of a portion of an exemplary phased array antenna panel according to one implementation of the present application. As illustrated in FIG. 1A, phased array antenna panel 100 includes substrate 102 having layers 102*a*, 102*b*, and 102*c*, front surface 104 having front end units 105, and master chip 180. In the present implementation, substrate 102 may be a multi-layer printed circuit board (PCB) having layers 102*a*, 102*b*, and 102*c*. Although only three layers are shown in FIG. 1A, in another implementation, substrate 102 may be a multi-layer PCB having greater or fewer than three layers.

As illustrated in FIG. 1A, front surface 104 having front end units 105 is formed on top layer 102*a* of substrate 102. In one implementation, substrate 102 of phased array antenna panel 100 may include 500 front end units 105, each having a radio frequency (RF) front end chip connected to a plurality of antennas (not explicitly shown in FIG. 1A). In one implementation, phased array antenna panel 100 may include 2000 antennas on front surface 104, where each front end unit 105 includes four antennas connected to an RF front end chip (not explicitly shown in FIG. 1A).

In the present implementation, master chip 180 may be formed in layer 102*c* of substrate 102, where master chip 180 may be connected to front end units 105 on top layer 102*a* using a plurality of control and data buses (not explicitly shown in FIG. 1A) routed through various layers of substrate 102. In the present implementation, master chip 180 is configured to provide phase shift and amplitude control signals from a digital core in master chip 180 to the RF front end chips in each of front end units 105 based on signals received from the antennas in each of front end units 105.

Figure 1B:
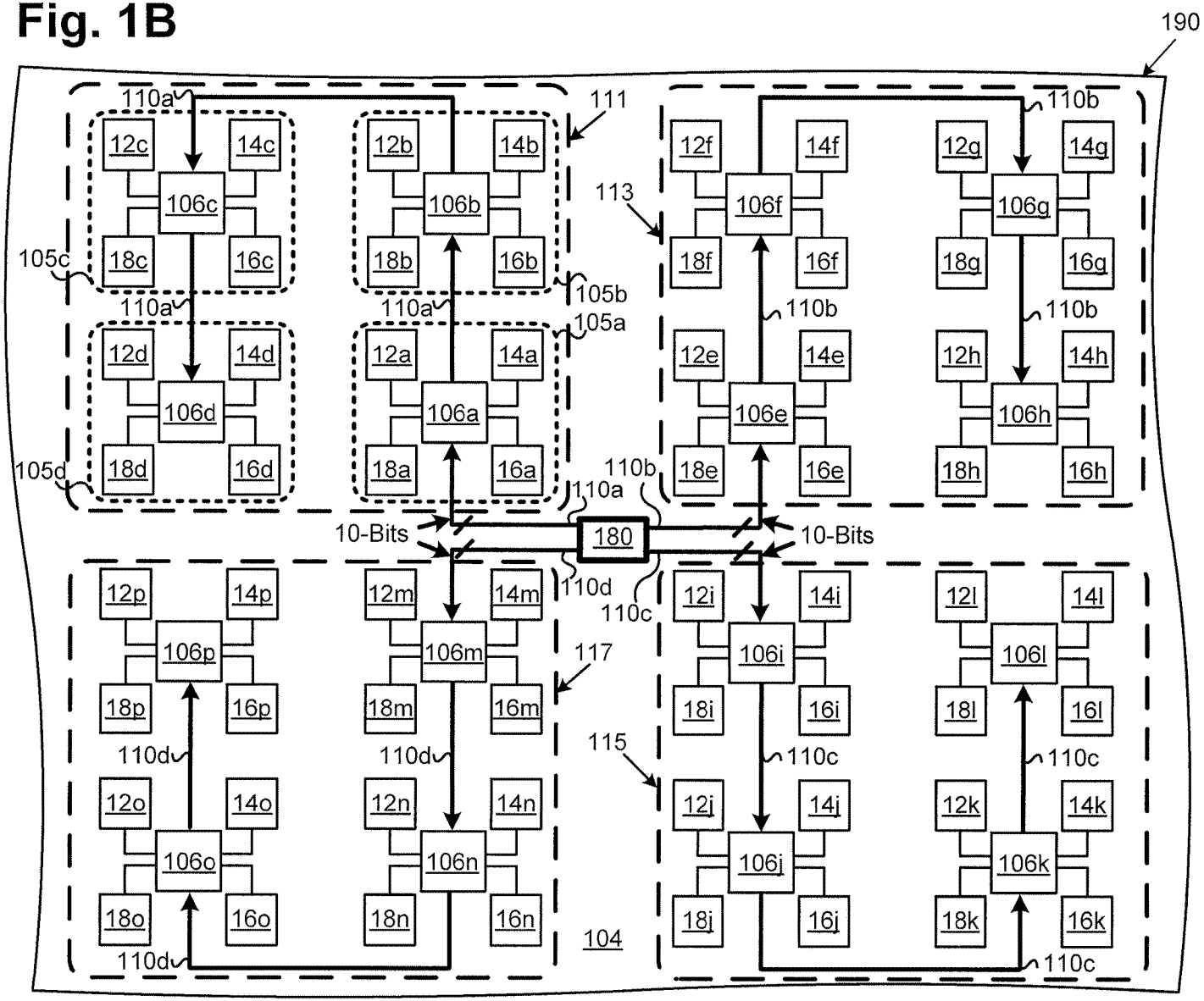
FIG. 1B illustrates a layout diagram of a portion of an exemplary phased array antenna panel according to one implementation of the present application.

FIG. 1B illustrates a layout diagram of a portion of an exemplary phased array antenna panel according to one implementation of the present application. For example, layout diagram 190 illustrates a layout of a simplified phased array antenna panel on a single printed circuit board (PCB), where master chip 180 is configured to drive in parallel four control and data buses, e.g., control and data buses 110*a*, 110*b*, 110*c*, and 110*d*, where each control and data bus is coupled to a respective antenna segment, e.g., antenna segments 111, 113, 115, and 117, where each antenna segment has four front end units, e.g., front end units 105*a*, 105*b*, 105*c*, and 105*d* in antenna segment 111, where each front end unit includes an RF front end chip, e.g., RF front end chip 106*a* in front end unit 105*a*, and where each RF front end chip is coupled to four antennas, e.g., antennas 12*a*, 14*a*, 16*a*, and 18*a* coupled to RF front end chip 106*a* in front end unit 105*a*.

As illustrated in FIG. 1B, front surface 104 includes antennas 12*a* through 12*p*, 14*a* through 14*p*, 16*a* through 16*p*, and 18*a* through 18*p*, collectively referred to as antennas 12-18. In one implementation, antennas 12-18 may be configured to receive and/or transmit signals from and/or to one or more commercial geostationary communication satellites or low earth orbit satellites.

In one implementation, for a wireless transmitter transmitting signals at 10 GHz (i.e., $\lambda$=30 mm), each antenna needs an area of at least a quarter wavelength (i.e., $\lambda/4$=7.5 mm) by a quarter wavelength (i.e., $\lambda/4$=7.5 mm) to receive the transmitted signals. As illustrated in FIG. 1B, antennas 12-18 in front surface 104 may each have a square shape having dimensions of 7.5 mm by 7.5 mm, for example. In one implementation, each adjacent pair of antennas 12-18 may be separated by a distance of a multiple integer of the quarter wavelength (i.e., $n*\lambda/4$), such as 7.5 mm, 15 mm, 22.5 mm and etc. In general, the performance of the phased array antenna panel improves with the number of antennas 12-18 on front surface 104.

In the present implementation, the phased array antenna panel is a flat panel array employing antennas 12-18, where antennas 12-18 are coupled to associated active circuits to form a beam for reception (or transmission). In one implementation, the beam is formed fully electronically by means of phase control devices associated with antennas 12-18. Thus, phased array antenna panel 100 can provide fully electronic beamforming without the use of mechanical parts.

As illustrated in FIG. 1B, RF front end chips 106*a* through 106*p*, and antennas 12*a* through 12*p*, 14*a* through 14*p*, 16*a* through 16*p*, and 18*a* through 18*p*, are divided into respective antenna segments 111, 113, 115, and 117. As further illustrated in FIG. 1B, antenna segment 111 includes front end unit 105*a* having RF front end chip 106*a* coupled to antennas 12*a*, 14*a*, 16*a*, and 18*a*, front end unit 105*b* having RF front end chip 106*b* coupled to antennas 12*b*, 14*b*, 16*b*, and 18*b*, front end unit 105*c* having RF front end chip 106*c* coupled to antennas 12*c*, 14*c*, 16*c*, and 18*c*, and front end unit 105*d* having RF front end chip 106*d* coupled to antennas 12*d*, 14*d*, 16*d*, and 18*d*. Antenna segment 113 includes similar front end units having RF front end chip 106*e* coupled to antennas 12*e*, 14*e*, 16*e*, and 18*e*, RF front end chip 106*f* coupled to antennas 12*f*, 14*f*, 16*f*, and 18*f*, RF front end chip 106*g* coupled to antennas 12*g*, 14*g*, 16*g*, and 18*g*, and RF front end chip 106*h* coupled to antennas 12*h*, 14*h*, 16*h*, and 18*h*. Antenna segment 115 also includes similar front end units having RF front end chip 106*i* coupled to antennas 12*i*, 14*i*, 16*i*, and 18*i*, RF front end chip 106*j* coupled to antennas 12*j*, 14*j*, 16*j*, and 18*j*, RF front end chip 106*k* coupled to antennas 12*k*, 14*k*, 16*k*, and 18*k*, and RF front end chip 106*l* coupled to antennas 12*l*, 14*l*, 16*l*, and 18*l*. Antenna segment 117 also includes similar front end units having RF front end chip 106*m* coupled to antennas 12*m*, 14*m*, 16*m*, and 18*m*, RF front end chip 106*n* coupled to antennas 12*n*, 14*n*, 16*n*, and 18*n*, RF front end chip 106*o* coupled to antennas 12*o*, 14*o*, 16*o*, and 18*o*, and RF front end chip 106*p* coupled to antennas 12*p*, 14*p*, 16*p*, and 18*p*.

As illustrated in FIG. 1B, master chip 108 is configured to drive in parallel control and data buses 110*a*, 110*b*, 110*c*, and 110*d* coupled to antenna segments 111, 113, 115, and 117, respectively. For example, control and data bus 110*a* is coupled to RF front end chips 106*a*, 106*b*, 106*c*, and 106*d* in antenna segment 111 to provide phase shift signals and amplitude control signals to the corresponding antennas coupled to each of RF front end chips 106*a*, 106*b*, 106*c*, and 106*d*. Control and data buses 110*b*, 110*c*, and 110*d* are configured to perform similar functions as control and data bus 110*a*. In the present implementation, master chip 180 and antenna segments 111, 113, 115, and 117 having RF front end chips 106*a* through 106*p* and antennas 12-18 are all integrated on a single printed circuit board.

It should be understood that layout diagram 190 in FIG. 1B is intended to show a simplified phased array antenna panel according to the present inventive concepts. In one implementation, master chip 180 may be configured to control a total of 2000 antennas disposed in ten antenna segments. In this implementation, master chip 180 may be configured to drive in parallel ten control and data buses, where each control and data bus is coupled to a respective antenna segment, where each antenna segment has a set of 50 RF front end chips and a group of 200 antennas are in each antenna segment; thus, each RF front end chip is coupled to four antennas. Even though this implementation describes each RF front end chip coupled to four antennas, this implementation is merely an example. An RF front end chip may be coupled to any number of antennas, particularly a number of antennas ranging from three to sixteen.

Figure 2:
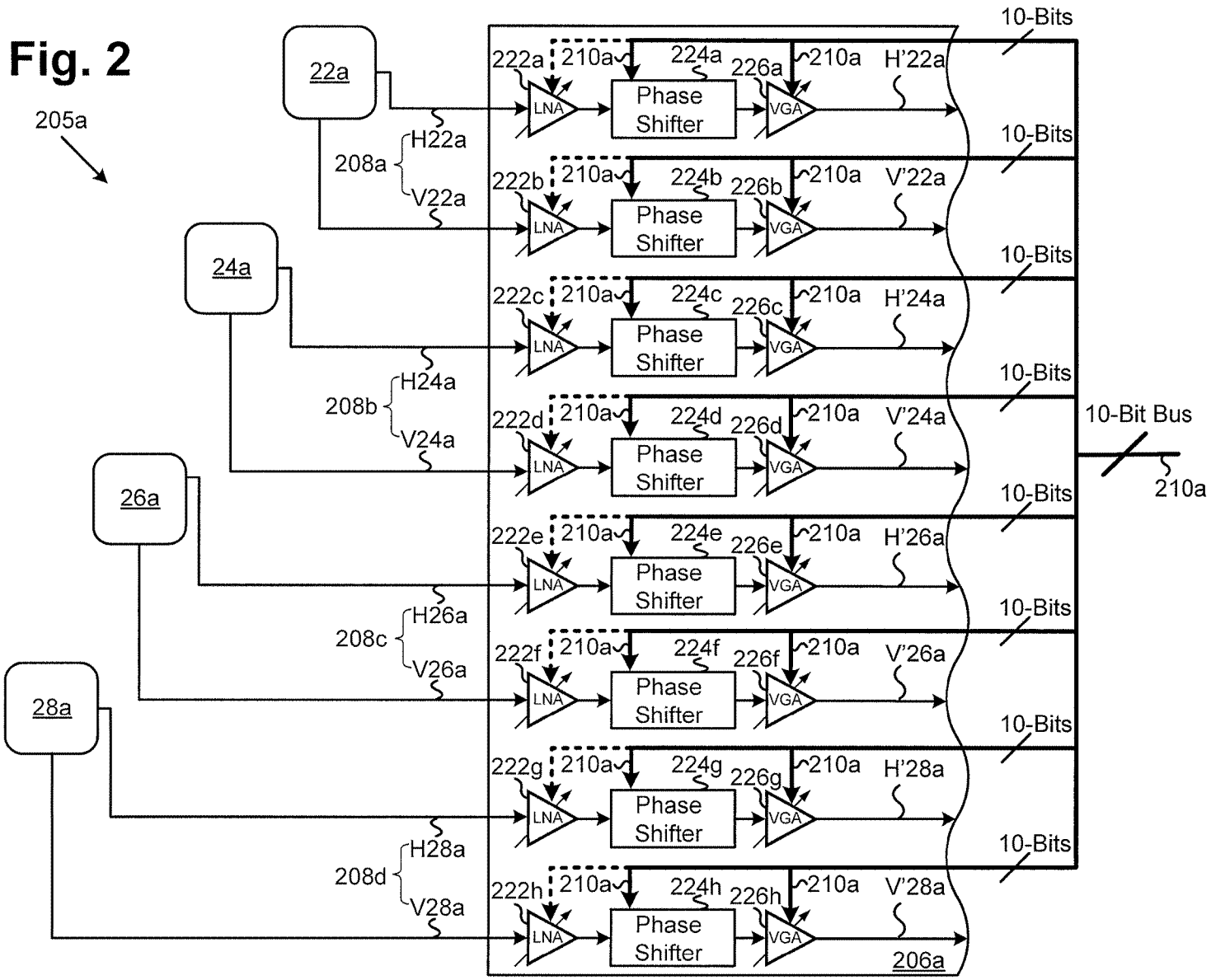
FIG. 2 illustrates a functional block diagram of a portion of an exemplary phased array antenna panel according to one implementation of the present application.

FIG. 2 illustrates a functional block diagram of a portion of an exemplary phased array antenna panel according to one implementation of the present application. In the present implementation, front end unit 205*a* may correspond to front end unit 105*a* in FIG. 1B of the present application. As illustrated in FIG. 2, front end unit 205*a* includes antennas 22*a*, 24*a*, 26*a*, and 28*a* coupled to RF front end chip 206*a*, where antennas 22*a*, 24*a*, 26*a*, and 28*a* and RF front end chip 206*a* may correspond to antennas 12*a*, 14*a*, 16*a*, and 18*a* and RF front end chip 106*a*, respectively, in FIG. 1B.

In the present implementation, antennas 22*a*, 24*a*, 26*a*, and 28*a* may be configured to receive signals from one or more commercial geostationary communication satellites, for example, which typically employ circularly polarized or linearly polarized signals defined at the satellite with a horizontally-polarized (H) signal having its electric-field oriented parallel with the equatorial plane and a vertically-polarized (V) signal having its electric-field oriented perpendicular to the equatorial plane. As illustrated in FIG. 2, each of antennas 22*a*, 24*a*, 26*a*, and 28*a* is configured to provide an H output and a V output to RF front end chip 206*a*.

For example, antenna 22*a* provides linearly polarized signal 208*a*, having horizontally-polarized signal H22*a* and vertically-polarized signal V22*a*, to RF front end chip 206*a*. Antenna 24*a* provides linearly polarized signal 208*b*, having horizontally-polarized signal H24*a* and vertically-polarized signal V24*a*, to RF front end chip 206*a*. Antenna 26*a* provides linearly polarized signal 208*c*, having horizontally-polarized signal H26*a* and vertically-polarized signal V26*a*, to RF front end chip 206*a*. Antenna 28*a* provides linearly polarized signal 208*d*, having horizontally-polarized signal H28*a* and vertically-polarized signal V28*a*, to RF front end chip 206*a*.

As illustrated in FIG. 2, horizontally-polarized signal H22*a* from antenna 22*a* is provided to a receiving chip having low noise amplifier (LNA) 222*a*, phase shifter 224*a* and variable gain amplifier (VGA) 226*a*, where LNA 222*a* is configured to generate an output to phase shifter 224*a*, and phase shifter 224*a* is configured to generate an output to VGA 226*a*. In addition, vertically-polarized signal V22*a* from antenna 22*a* is provided to a receiving chip including low noise amplifier (LNA) 222*b*, phase shifter 224*b* and variable gain amplifier (VGA) 226*b*, where LNA 222*b* is configured to generate an output to phase shifter 224*b*, and phase shifter 224*b* is configured to generate an output to VGA 226*b*.

As shown in FIG. 2, horizontally-polarized signal H24*a* from antenna 24*a* is provided to a receiving chip having low noise amplifier (LNA) 222*c*, phase shifter 224*c* and variable gain amplifier (VGA) 226*c*, where LNA 222*c* is configured to generate an output to phase shifter 224*c*, and phase shifter 224*c* is configured to generate an output to VGA 226*c*. In addition, vertically-polarized signal V24*a* from antenna 24*a* is provided to a receiving chip including low noise amplifier (LNA) 222*d*, phase shifter 224*d* and variable gain amplifier (VGA) 226*d*, where LNA 222*d* is configured to generate an output to phase shifter 224*d*, and phase shifter 224*d* is configured to generate an output to VGA 226*d*.

As illustrated in FIG. 2, horizontally-polarized signal H26*a* from antenna 26*a* is provided to a receiving chip having low noise amplifier (LNA) 222*e*, phase shifter 224*e* and variable gain amplifier (VGA) 226*e*, where LNA 222*e* is configured to generate an output to phase shifter 224*e*, and phase shifter 224*e* is configured to generate an output to VGA 226*e*. In addition, vertically-polarized signal V26*a* from antenna 26*a* is provided to a receiving chip including low noise amplifier (LNA) 222*f*, phase shifter 224*f* and variable gain amplifier (VGA) 226*f*, where LNA 222*f* is configured to generate an output to phase shifter 224*f*, and phase shifter 224*f* is configured to generate an output to VGA 226*f*.

As further shown in FIG. 2, horizontally-polarized signal H28*a* from antenna 28*a* is provided to a receiving chip having low noise amplifier (LNA) 222*g*, phase shifter 224*g* and variable gain amplifier (VGA) 226*g*, where LNA 222*g* is configured to generate an output to phase shifter 224*g*, and phase shifter 224*g* is configured to generate an output to VGA 226*g*. In addition, vertically-polarized signal V28*a* from antenna 28*a* is provided to a receiving chip including low noise amplifier (LNA) 222*h*, phase shifter 224*h* and variable gain amplifier (VGA) 226*h*, where LNA 222*h* is configured to generate an output to phase shifter 224*h*, and phase shifter 224*h* is configured to generate an output to VGA 226*h*.

As further illustrated in FIG. 2, control and data bus 210*a*, which may correspond to control and data bus 110*a* in FIG. 1B, is provided to RF front end chip 206*a*, where control and data bus 210*a* is configured to provide phase shift signals to phase shifters 224*a*, 224*b*, 224*c*, 224*d*, 224*e*, 224*f*, 224*g*, and 224*h* in RF front end chip 206*a* to cause a phase shift in at least one of these phase shifters, and to provide amplitude control signals to VGAs 226*a*, 226*b*, 226*c*, 226*d*, 226*e*, 226*f*, 226*g*, and 226*h*, and optionally to LNAs 222*a*, 222*b*, 222*c*, 222*d*, 222*e*, 222*f*, 222*g*, and 222*h* in RF front end chip 206*a* to cause an amplitude change in at least one of the linearly polarized signals received from antennas 22*a*, 24*a*, 26*a*, and 28*a*. It should be noted that control and data bus 210*a* is also provided to other front end units, such as front end units 105*b*, 105*c*, and 105*d* in segment 111 of FIG. 1B. In one implementation, at least one of the phase shift signals carried by control and data bus 210*a* is configured to cause a phase shift in at least one linearly polarized signal, e.g., horizontally-polarized signals H22*a* through H28*a* and vertically-polarized signals V22*a* through V28*a*, received from a corresponding antenna, e.g., antennas 22*a*, 24*a*, 26*a*, and 28*a*.

In one implementation, amplified and phase shifted horizontally-polarized signals H'22*a*, H'24*a*, H'26*a*, and H'28*a* in front end unit 205*a*, and other amplified and phase shifted horizontally-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide an H-combined output to a master chip such as master chip 180 in FIG. 1. Similarly, amplified and phase shifted vertically-polarized signals V'22*a*, V'24*a*, V'26*a*, and V'28*a* in front end unit 205*a*, and other amplified and phase shifted vertically-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide a V-combined output to a master chip such as master chip 180 in FIG. 1.

Figure 3A:
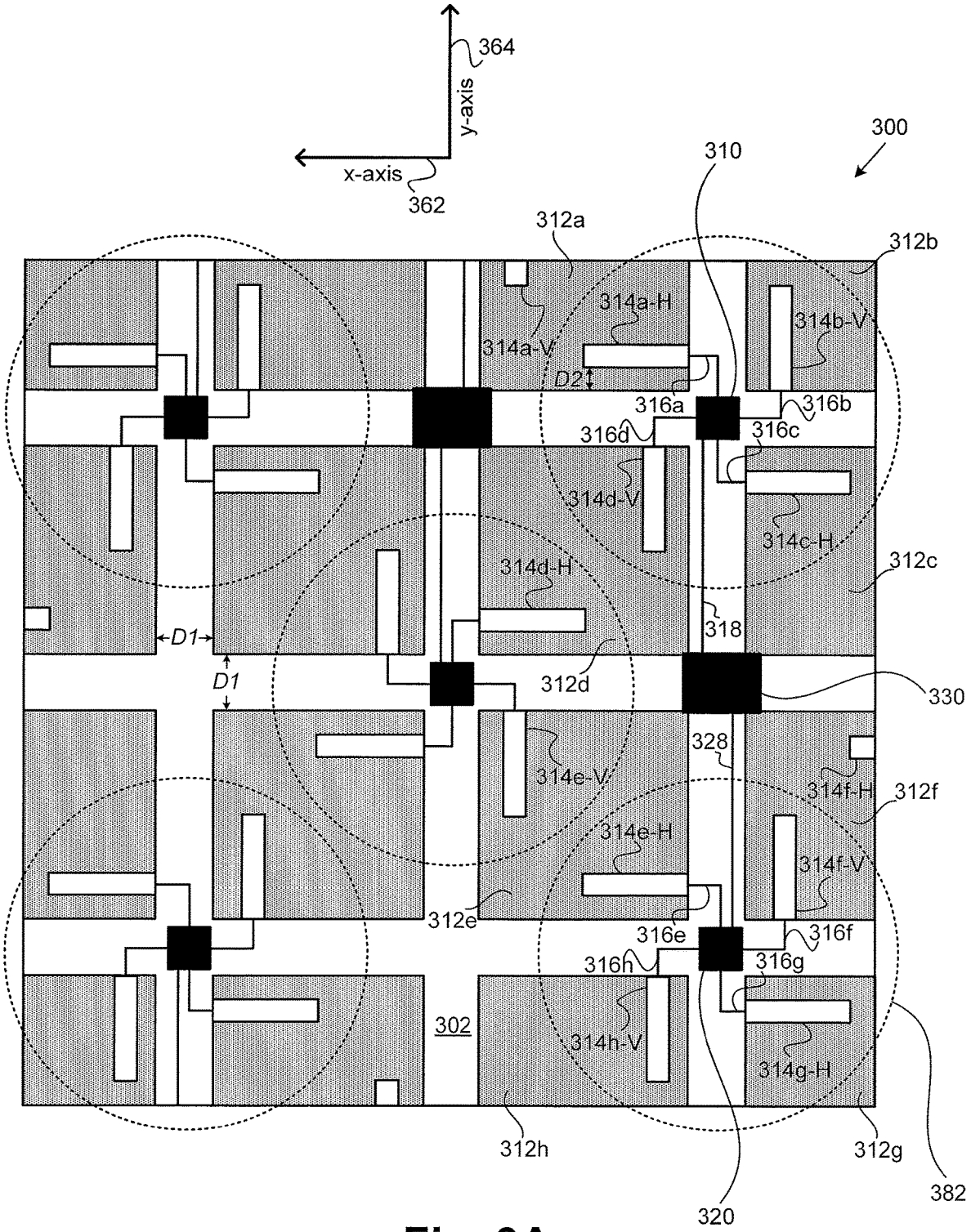
FIG. 3A illustrates a top view of a portion of an exemplary phased array antenna panel according to one implementation of the present application.

FIG. 3A illustrates a top view of a portion of an exemplary phased array antenna panel according to one implementation of the present application. As illustrated in FIG. 3A, exemplary phased array antenna panel 300 includes substrate 302, RF front end chips 310 and 320, antennas 312*a*, 312*b*, 312*c*, 312*d*, 312*e* 312*f*, 312*g*, and 312*h*, collectively referred to as antennas 312, probes 314*a*-V, 314*a*-H, 314*b*-V, 314*c*-H, 314*d*-V, 314*d*-H, 314*e*-V, 314*e*-H, 314*f*-V, 314*f*-H, 314*g*-H, and 314*h*-V, collectively referred to as probes 314, electrical connectors 316*a*, 316*b*, 316*c*, 316*d*, 316*e*, 316*f*, 316*g*, and 316*h*, collectively referred to as electrical connectors 316, signal lines 318 and 328, and combiner RF chip 330. Some features discussed in conjunction with the layout diagram of FIG. 1B, such as a master chip and control and data buses are omitted in FIG. 3A for the purposes of clarity.

As illustrated in FIG. 3A, antennas 312 are arranged on the top surface of substrate 302. In the present example, antennas 312 have substantially square shapes, or substantially rectangular shapes, and are aligned with each other. In this example, the distance between each antenna and an adjacent antenna is a fixed distance. As illustrated in the example of FIG. 3A, fixed distance D1 separates various adjacent antennas. In one implementation, distance D1 may be a quarter wavelength (i.e., λ/4). Antennas 312 may be, for example, cavity antennas or patch antennas or other types of antennas. The shape of antennas 312 may correspond to, for example, the shape of an opening in a cavity antenna or the shape of an antenna plate in a patch antenna. In other implementations, antennas 312 may have substantially circular shapes, or may have any other shapes. In some implementations, some of antennas 312 may be offset rather than aligned. In various implementations, distance D1 may be less than or greater than a quarter wavelength (i.e., less than or greater than λ/4), or the distance between each antenna and an adjacent antenna might not be a fixed distance.

As further illustrated in FIG. 3A, RF front end chips 310 and 320 are arranged on the top surface of substrate 302. RF front end chip 310 is adjacent to antennas 312*a*, 312*b*, 312*c*, and 312*d*. RF front end chip 320 is adjacent to antennas 312*e*, 312*f*, 312*g*, and 312*h*. Thus, each of RF front end chips 310 and 320 is adjacent to four antennas. RF front end chip 310 may be substantially centered or generally between antennas 312*a*, 312*b*, 312*c*, and 312*d*. Similarly, RF front end chip 320 may be substantially centered or generally between antennas 312*e*, 312*f*, 312*g*, and 312*h*. In other implementations, each of RF front end chips 310 and 320 may be between a number of adjacent antennas that is fewer than four or greater than four.

FIG. 3A illustrates probes 314 disposed in antennas 312. As illustrated in FIG. 3A, probes 314 may or may not be completely flush at the corners of antennas 312. For example, in antenna 312*a*, distance D2 may separate probe 314*a*-H the corner of antenna 312*a* adjacent to RF front end chip 310. Distance D2 may be, for example, a distance that allows tolerance during production or alignment of probes 314. In one example, the distance between RF front end chip 310 and probe 314*a*-H may be less than approximately 2 millimeters.

FIG. 3A further illustrates exemplary orientations of an x-axis (e.g., x-axis 362) and a perpendicular, or substantially perpendicular, y-axis (e.g., y-axis 364). Each of antennas 312 may have two probes, one probe parallel to x-axis 362 and the other probe parallel to y-axis 364. For example, antenna 312*d* has probe 314*d*-H parallel to x-axis 362, and probe 314*d*-V parallel to y-axis 364. Although the top view provided by FIG. 3A shows only one probe of antennas 312*b*, 312*c*, 312*g*, and 312*h*, the other probe of each of antennas 312*b*, 312*c*, 312*g*, and 312*h* may be disposed in a portion of the antenna that cannot be seen in the top view provided by FIG. 3A. Probes parallel to x-axis 362 may be configured to receive or transmit horizontally-polarized signals, as stated above. Probes parallel to y-axis 364 may be configured to receive or transmit vertically-polarized signals, as stated above. Thus, each of antennas 312 may have one horizontally-polarized probe and one vertically-polarized probe. In other implementations, each of antennas 312 may have any number of probes 314, and probes 314 may have any orientations and polarizations.

FIG. 3A further shows electrical connectors 316*a*, 316*b*, 316*c*, and 316*d*, coupling probes 314*a*-H, 314*b*-V, 314*c*-H, and 314*d*-V to RF front end chip 310, as well as electrical connectors 316*e*, 316*f*, 316*g*, and 316*h*, coupling probes 314*e*-H, 314*f*-V, 314*g*-H, and 314*h*-V to RF front end chip 320. In FIG. 3A, the dashed circles, such as dashed circle 382, surround each RF front end chip and its coupled probes. Electrical connectors 316 may be, for example, traces in substrate 302. Electrical connectors 316*a*, 316*b*, 316*c*, and 316*d* provide input signals to RF front end chip 310 from respective antennas 312*a*, 312*b*, 312*c*, and 312*d*. Electrical connectors 316*e*, 316*f*, 316*g*, and 316*h* provide input signals to RF front end chip 320 from respective antennas 312*e*, 312*f*, 312*g*, and 312*h*. Thus, each of RF front end chips 310 and 320 receives four input signals from four respective antennas. As stated above, RF front end chips 310 and 320 produce output signals based on these input signals. As stated above, a master chip (not shown in FIG. 3A) may provide phase shift and amplitude control signals to antennas 312 through RF front end chips 310 and 320. In other implementations, each of RF front end chips 310 and 320 may receive a number of input signals that is fewer than four or greater than four. In other implementations, each of RF front end chips 310 and 320 may receive more than one input signal from each of antennas 312.

FIG. 3A further illustrates signal lines 318 and 328 coupling respective RF front end chips 310 and 320 to combiner RF chip 330. Signal lines 318 and 328 may be, for example, traces in substrate 302. In this example, signal lines 318 and 328 each provide an output signal from respective RF front end chips 310 and 320 to combiner RF chip 330. In other implementations, each of RF front end chips 310 and 320 may produce more than one output signal, and more signal lines may be used. In this example, combiner RF chip 330 is arranged on the top surface of substrate 302, substantially centered between RF front end chips 310 and 320. In other implementations, the combiner RF chip may be arranged in substrate 302, or may not be substantially centered between RF front end chips 310 and 320.

Figure 3B:
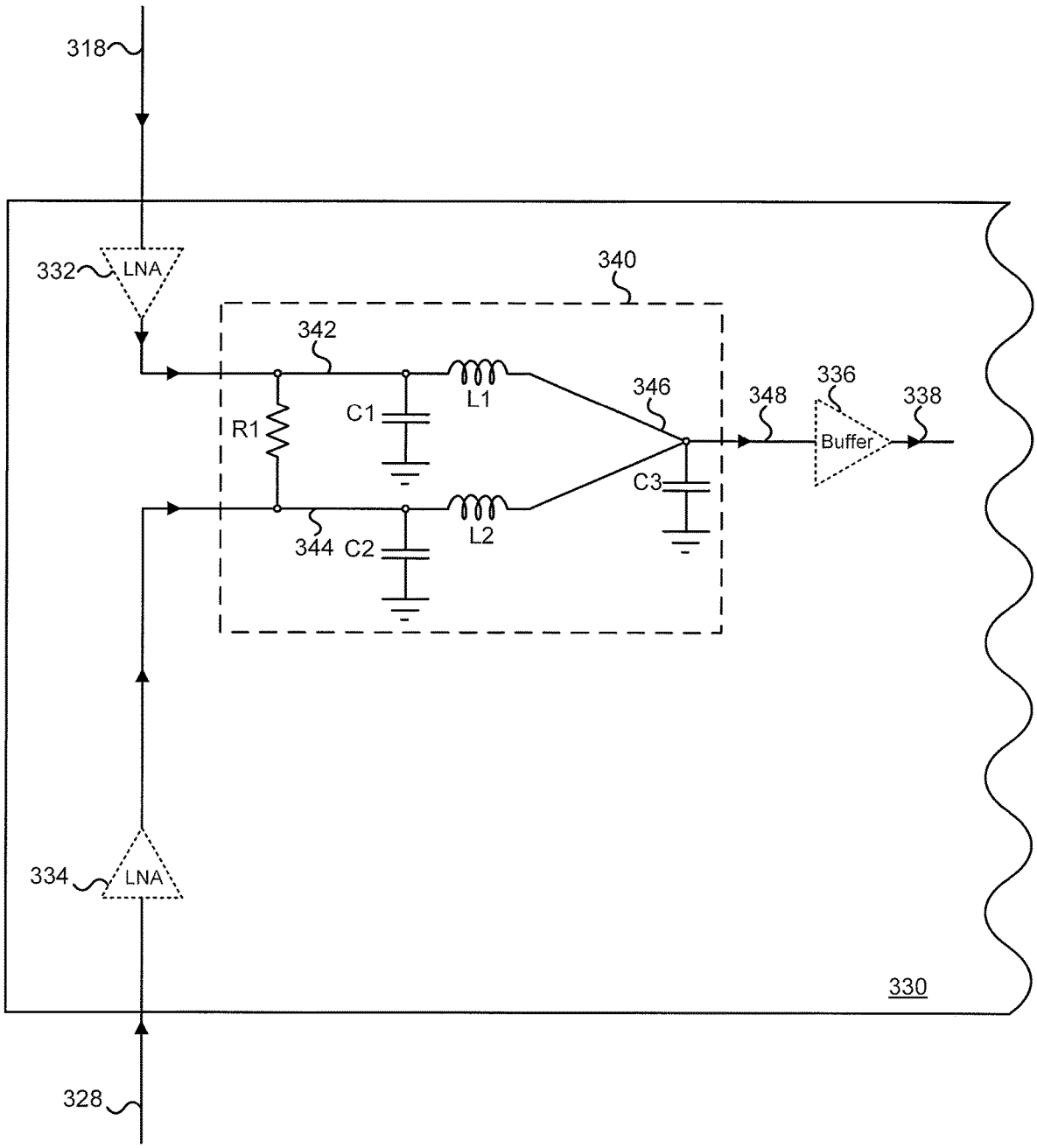
FIG. 3B illustrates an exemplary circuit diagram of a portion of an exemplary combiner RF chip according to one implementation of the present application.

FIG. 3B illustrates an exemplary circuit diagram of a portion of an exemplary combiner RF chip according to one implementation of the present application. As illustrated in FIG. 3B, exemplary combiner RF chip 330 receives signal lines 318 and 328, and includes optional input buffers 332 and 334, exemplary power combiner 340, power combined output line 348, optional output buffer 336, and buffered power combined output line 338. Combiner RF chip 330 in FIG. 3B corresponds to combiner RF chip 330 in FIG. 3A. Signal lines 318 and 328 in FIG. 3B correspond to respective signal lines 318 and 328 in FIG. 3A received from respective RF front end chips 310 and 320 in FIG. 3A. Signal lines 318 and 328 are fed into respective optional input buffers 332 and 334 on combiner RF chip 330. Input buffers 332 and 334 may be, for example, LNAs ("low noise amplifiers"). Input buffers 332 and 334 may provide gain and noise reduction to signals received from signal lines 318 and 328.

As illustrated in FIG. 3B, power combiner 340 is arranged on combiner RF chip 330. Power combiner 340 includes on-chip resistor R1, on-chip inductors L1 and L2, on-chip capacitors C1, C2, and C3, and nodes 342, 344, and 346. Signal lines 318 and 328 are fed into power combiner 340 at respective nodes 342 and 344. On-chip resistor R1 is coupled between nodes 342 and 344. On-chip inductor L1 is coupled between nodes 342 and 346. On-chip inductor L2 is coupled between nodes 344 and 346. On-chip capacitor C1 is coupled between node 342 and ground. On-chip capacitor C2 is coupled between node 344 and ground. On-chip capacitor C3 is coupled between node 346 and ground. Node 346 is coupled to power combined output line 348. The impedance, inductance and capacitance values for on-chip resistor R1, on-chip inductors L1 and L2, and on-chip capacitors C1, C2, and C3 may be chosen such that the impedance of each of signal lines 318 and 328, or the output impedance of optional buffers 332 and 334, in case such optional buffers are used, is matched to the impedance of power combined output line 348. In the present example, power combiner 340 is a lumped-element power combiner. In other implementations, power combiner 340 may be a microstrip power combiner, or any other power combiner.

As further illustrated in FIG. 3B, power combiner 340 on combiner RF chip 330 produces a power combined output signal at power combined output line 348. Power combined output signal at power combined output line 348 is a combination of powers of signals at signal lines 318 and 328. Signal lines 318 and 328 in FIG. 3B correspond to output signals of respective RF front end chips 310 and 320 in FIG. 3A, as stated above. Thus, the power combined output signal at power combined output line 348 is a combination of powers of output signals from RF front end chips 310 and 320. Power combined output line 348 may then be fed into other circuitry in combiner RF chip 330 or directly into transmission lines of phased array antenna panel 300. Because combiner RF chip 330 receives output signals of RF front end chips 310 and 320 and produces a power combined output signal that is a combination of powers of those output signals, a higher power signal can be fed into a transmission line driven by power combined output line 348, or if optional output buffer 336 is used, driven by buffered power combined output line 338. In addition, relatively short transmission lines (for signal lines 318 and 328) are used for each output signal of RF front end chips 310 and 320. Thus, phased array antenna panel 300 achieves reduced passive signal loss.

FIG. 3B also illustrates power combined output line from power combiner 340 fed into optional output buffer 336. Output buffer 336 may be, for example, a unity gain buffer, an amplifier, or an op-amp. Output buffer 336 may increase the resilience of power combiner 340, especially against subsequent loads in phased array antenna panel 300. Output buffer 336 in combiner RF chip 330 generates a buffered power combined output signal at buffered power combined output line 338 based on power combined output signal at power combined output line 348. Because combiner RF chip 330 receives output signals of RF front end chips 310 and 320 and can produce a buffered power combined output line 338 that is a combination of powers of those output signals, an output buffer is not required for each output signal of RF front end chips 310 and 320. Thus phased array antenna panel 300 achieves reduced number of active amplifier circuits.

Figure 4A:
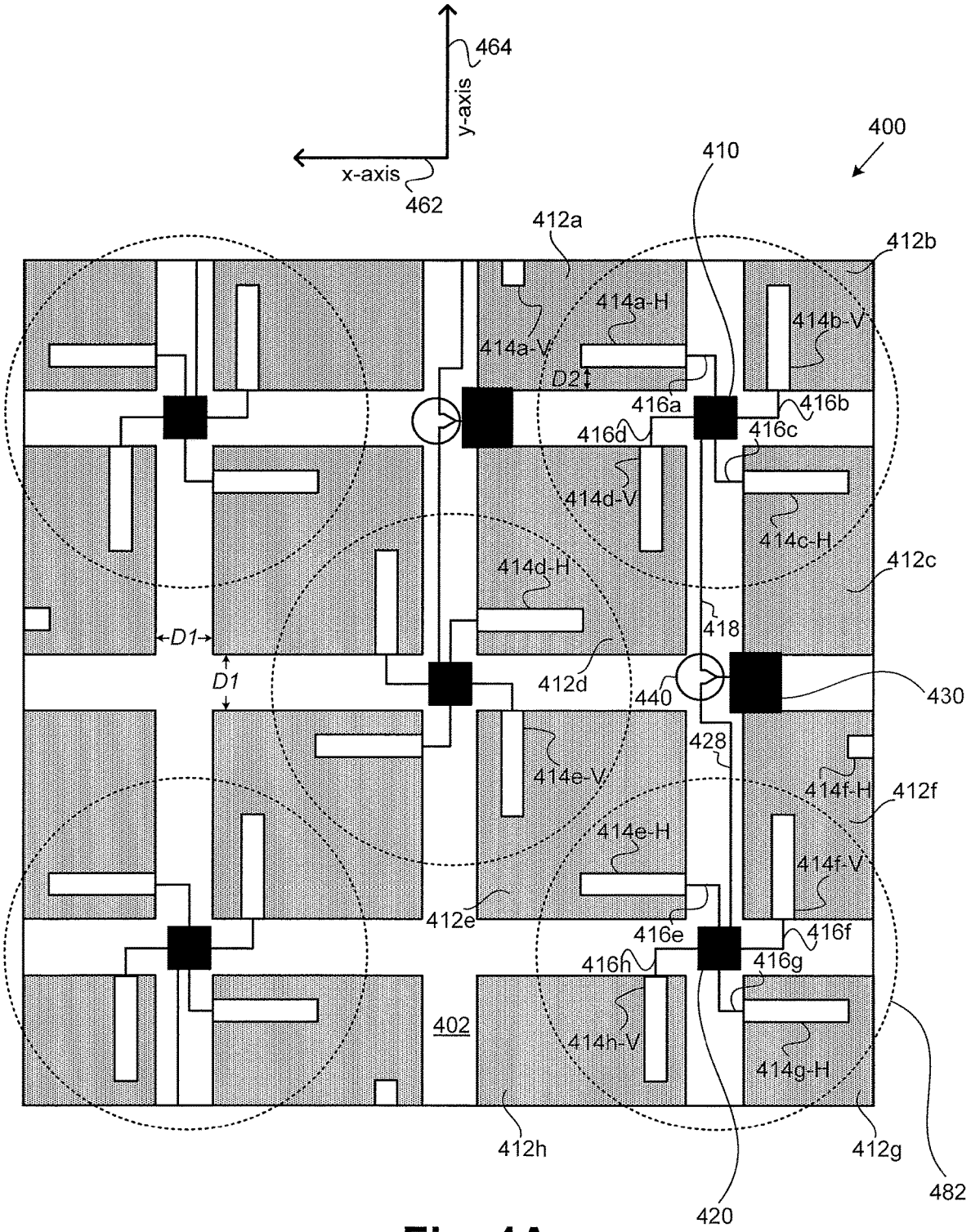
FIG. 4A illustrates a top view of a portion of an exemplary phased array antenna panel according to one implementation of the present application.

FIG. 4A illustrates a top view of a portion of an exemplary phased array antenna panel according to one implementation of the present application. As illustrated in FIG. 4A, exemplary phased array antenna panel 400 includes substrate 402, RF front end chips 410 and 420, antennas 412*a*, 412*b*, 412*c*, 412*d*, 412*e* 412*f*, 412*g*, and 412*h*, collectively referred to as antennas 412, probes 414*a*-V, 414*a*-H, 414*b*-V, 414*c*-H, 414*d*-V, 414*d*-H, 414*e*-V, 414*e*-H, 414*f*-V, 414*f*-H, 414*g*-H, and 414*h*-V, collectively referred to as probes 414, electrical connectors 416*a*, 416*b*, 416*c*, 416*d*, 416*e*, 416*f*, 416*g*, and 416*h*, collectively referred to as electrical connectors 416, signal lines 418 and 428, combiner RF chip 430, and power combiner 440. Some features discussed in conjunction with the layout diagram of FIG. 1B, such as a master chip and control and data buses are omitted in FIG. 4A for the purposes of clarity.

As illustrated in FIG. 4A, antennas 412 are arranged on the top surface of substrate 402. In the present example, antennas 412 have substantially square shapes, or substantially rectangular shapes, and are aligned with each other. In this example, the distance between each antenna and an adjacent antenna is a fixed distance. As illustrated in the example of FIG. 4A, fixed distance D1 separates various adjacent antennas. In one implementation, distance D1 may be a quarter wavelength (i.e., $\lambda/4$). Antennas 412 may be, for example, cavity antennas or patch antennas or other types of antennas. The shape of antennas 412 may correspond to, for example, the shape of an opening in a cavity antenna or the shape of an antenna plate in a patch antenna. In other implementations, antennas 412 may have substantially circular shapes, or may have any other shapes. In some implementations, some of antennas 412 may be offset rather than aligned. In various implementations, distance D1 may be less than or greater than a quarter wavelength (i.e., less than or greater than $\lambda/4$), or the distance between each antenna and an adjacent antenna might not be a fixed distance.

As further illustrated in FIG. 4A, RF front end chips 410 and 420 are arranged on the top surface of substrate 402. RF front end chip 410 is adjacent to antennas 412*a*, 412*b*, 412*c*, and 412*d*. RF front end chip 420 is adjacent to antennas 412*e*, 412*f*, 412*g*, and 412*h*. Thus, each of RF front end chips 410 and 420 is adjacent to four antennas. RF front end chip 410 may be substantially centered or generally between antennas 412*a*, 412*b*, 412*c*, and 412*d*. Similarly, RF front end chip 420 may be substantially centered or generally between antennas 412*e*, 412*f*, 412*g*, and 412*h*. In other implementations, each of RF front end chips 410 and 420 may be between a number of adjacent antennas that is fewer than four or greater than four.

FIG. 4A illustrates probes 414 disposed in antennas 412. As illustrated in FIG. 4A, probes 414 may or may not be completely flush at the corners of antennas 412. For example, in antenna 412*a*, distance D2 may separate probe 414*a*-H from the corner of antenna 412*a* adjacent to RF front end chip 410. Distance D2 may be, for example, a distance that allows tolerance during production or alignment of probes 414. In one example, the distance between RF front end chip 410 and probe 414*a*-H may be less than approximately 2 millimeters.

FIG. 4A further illustrates exemplary orientations of an x-axis (e.g., x-axis 462) and a perpendicular, or substantially perpendicular, y-axis (e.g., y-axis 464). Each of antennas 412 may have two probes, one probe parallel to x-axis 462 and the other probe parallel to y-axis 464. For example, antenna 412*d* has probe 414*d*-H parallel to x-axis 462, and probe 414*d*-V parallel to y-axis 464. Although the top view provided by FIG. 4A shows only one probe of antennas 412*b*, 412*c*, 412*g*, and 412*h*, the other probe of each of antennas 412*b*, 412*c*, 412*g*, and 412*h* may be disposed in a portion of the antenna that cannot be seen in the top view provided by FIG. 4A. Probes parallel to x-axis 462 may be configured to receive or transmit horizontally-polarized signals, as stated above. Probes parallel to y-axis 464 may be configured to receive or transmit vertically-polarized signals, as stated above. Thus, each of antennas 412 may have one horizontally-polarized probe and one vertically-polarized probe. In other implementations, each of antennas 412 may have any number of probes 414, and probes 414 may have any orientations and polarizations.

FIG. 4A further shows electrical connectors 416*a*, 416*b*, 416*c*, and 416*d*, coupling probes 414*a*-H, 414*b*-V, 414*c*-H, and 414*d*-V to RF front end chip 410, as well as electrical connectors 416*e*, 416*f*, 416*g*, and 416*h*, coupling probes 414*e*-H, 414*f*-V, 414*g*-H, and 414*h*-V to RF front end chip 420. In FIG. 4A, the dashed circles, such as dashed circle 482, surround each RF front end chip and its coupled probes. Electrical connectors 416 may be, for example, traces in substrate 402. Electrical connectors 416*a*, 416*b*, 416*c*, and 416*d* provide input signals to RF front end chip 410 from respective antennas 412*a*, 412*b*, 412*c*, and 412*d*. Electrical connectors 416*e*, 416*f*, 416*g*, and 416*h* provide input signals to RF front end chip 420 from respective antennas 412*e*, 412*f*, 412*g*, and 412*h*. Thus, each of RF front end chips 410 and 420 receives four input signals from four respective antennas. As stated above, RF front end chips 410 and 420 produce output signals based on these input signals. As stated above, a master chip (not shown in FIG. 4A) may provide phase shift and amplitude control signals to antennas 412 through RF front end chips 410 and 420. In other implementations, each of RF front end chips 410 and 420 may receive a number of input signals that is fewer than four or greater than four. In other implementations, each of RF front end chips 410 and 420 may receive more than one input signal from each of antennas 412.

FIG. 4A further illustrates signal lines 418 and 428 coupling respective RF front end chips 410 and 420 to power combiner 440. Signal lines 418 and 428 may be, for example, traces in substrate 402. In this example, signal lines 418 and 428 each provide an output signal from respective RF front end chips 410 and 420 to power combiner 440. In other implementations, each of RF front end chips 410 and 420 may produce more than one output signal, and more signal lines may be used. Power combiner 440 is coupled to combiner RF chip 430. Combiner RF chip 430 receives a power combined output signal from power combiner 440, as described below. In this example, power combiner 440 and combiner RF chip 430 are arranged on the top surface of substrate 402, substantially centered between RF front end chips 410 and 420. In other implementations, power combiner 440 and/or combiner RF chip 430 may be arranged in substrate 402, or may not be substantially centered between RF front end chips 410 and 420.

Figure 4B:
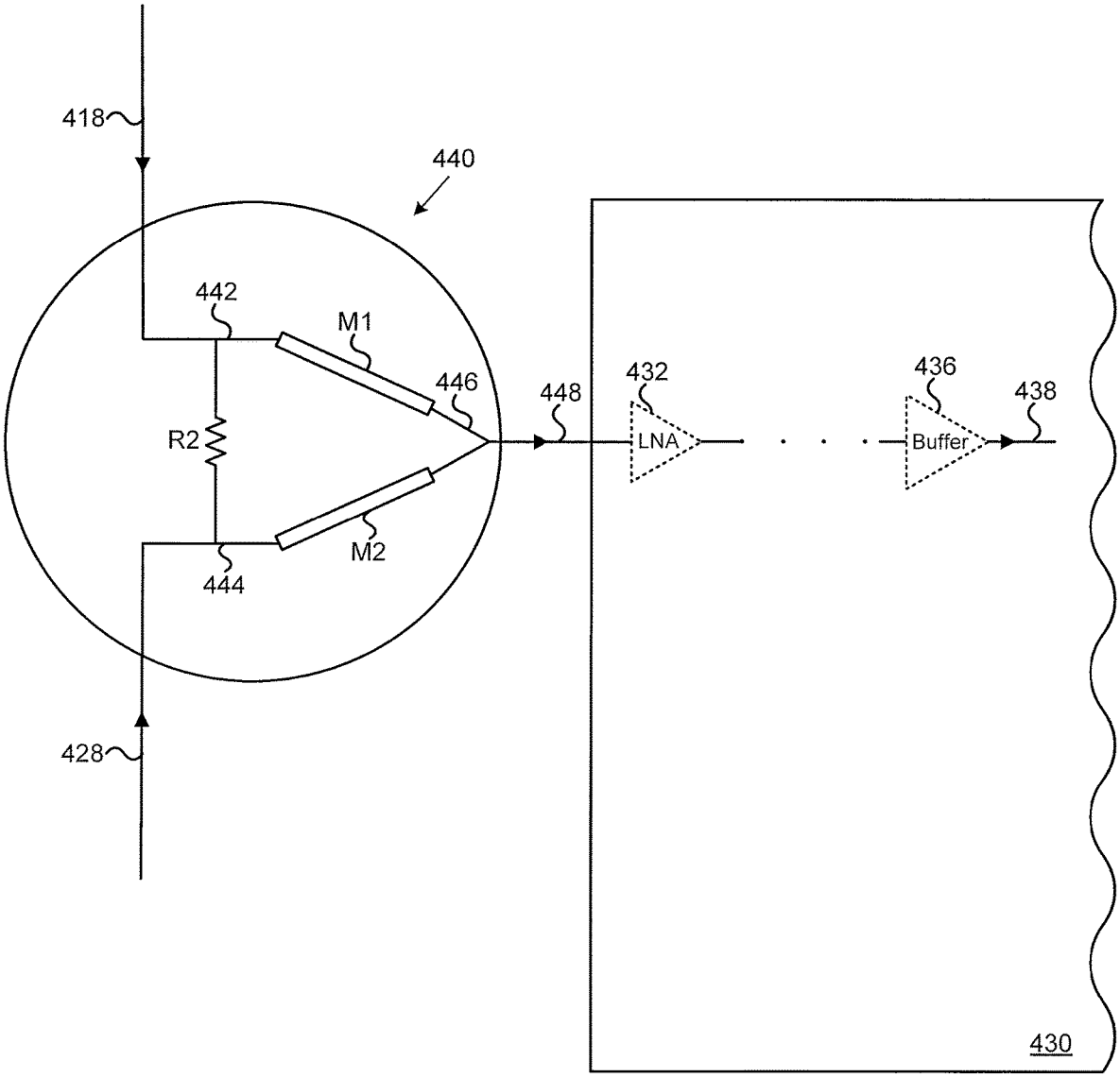
FIG. 4B illustrates an exemplary circuit diagram of a portion of an exemplary power combiner and a portion of an exemplary combiner RF chip according to one implementation of the present application.

FIG. 4B illustrates exemplary circuit diagrams of a portion of an exemplary power combiner and a portion of an exemplary combiner RF chip according to one implementation of the present application. As illustrated in FIG. 4B, exemplary power combiner 440 receives signal lines 418 and 428, and includes resistor R2, microstrips M1 and M2, nodes 442, 444, and 446, and power combined output line 448. Power combiner 440 in FIG. 4B corresponds to power combiner 440 in FIG. 4A. Signal lines 418 and 428 in FIG. 4B correspond to respective signal lines 418 and 428 in FIG. 4A, and receive output signals from respective RF front end chips 410 and 420 in FIG. 4A. Signal lines 418 and 428 are fed into power combiner 440 at respective nodes 442 and 444. Resistor R2 is coupled between nodes 442 and 444. Microstrip M1 is coupled between nodes 442 and 446. Microstrip M2 is coupled between nodes 444 and 446. Node 446 is coupled to power combined output line 448. Characteristic impedance values for resistor R2 and microstrips M1 and M2 may be chosen such that the impedance of each of signal lines 418 and 428 is matched to the impedance of power combined output line 448. For example, resistor R2 may have an impedance equal to twice the impedance of each of signal lines 418 and 428 (i.e., $2*Z_0$), and each of microstrips M1 and M2 may have a length equal to a quarter wavelength (i.e., $\lambda/4$) and an impedance equal to the impedance of each of signal lines 418 and 428 times the square root of two (i.e., $\sqrt{2}*Z_0$). In the present example, power combiner 440 is a microstrip power combiner. In other implementations, power combiner 440 may be a lumped-element power combiner, or any other power combiner.

As illustrated in FIG. 4B, power combiner 440 produces a power combined output signal at power combined output line 448. Power combined output signal at power combined output line 448 is a combination of powers of signals at signal lines 418 and 428. Signal lines 418 and 428 in FIG. 4B correspond to output signals of respective RF front end chips 410 and 420 in FIG. 4A, as stated above. Thus, the power combined output signal at power combined output line 448 is a combination of powers of output signals from RF front end chips 410 and 420. In other implementations, power combined output signal at power combined output line 448 may be a combination of powers of more than two output signals from any number of RF front end chips.

As further illustrated in FIG. 4B, exemplary combiner RF chip 430 receives power combined output line 448, and includes optional input buffer 432 and optional output buffer 436, and buffered power combined output line 438. Combiner RF chip 430 in FIG. 4B corresponds to combiner RF chip 430 in FIG. 4A. Combiner RF chip 430 receives a power combined output signal from power combiner 440 at power combined output line 448. Power combined output line 448 is fed into optional input buffer 432 on combiner RF chip 430. Input buffer 432 may be, for example, an LNA. Input buffer 432 may provide gain and noise reduction to signals received from power combined output line 448.

FIG. 4B also illustrates power combined output line 448 fed into optional output buffer 436. Output buffer 436 may be, for example, a unity gain buffer, an amplifier, or an op-amp. Output buffer 436 may increase the resilience of power combiner 440, especially against subsequent loads in phased array antenna panel 400. Output buffer 436 in combiner RF chip 430 generates a buffered power combined output signal at line 438 based on power combined output signal received from line 448. Power combined output line 448 may then be fed into transmission lines of phased array antenna panel 400. Because combiner RF chip 430 receives a power combined output signal that is a combination of powers of output signals of RF front end chips 410 and 420, a higher power signal can be fed into a transmission line driven by power combined output line 448. In addition, relatively short transmission lines (for signal lines 418 and 428) are used for each output signal of RF front end chips 410 and 420. Thus, phased array antenna panel 400 achieves reduced passive signal loss. Also, because combiner RF chip 430 receives output signals of RF front end chips 410 and 420 and can produce a buffered power combined output line 438 that is a combination of powers of those output signals, an output buffer is not required for each output signal of RF front end chips 410 and 420. Thus phased array antenna panel 400 achieves reduced number of active amplifier circuits.

Figure 5:
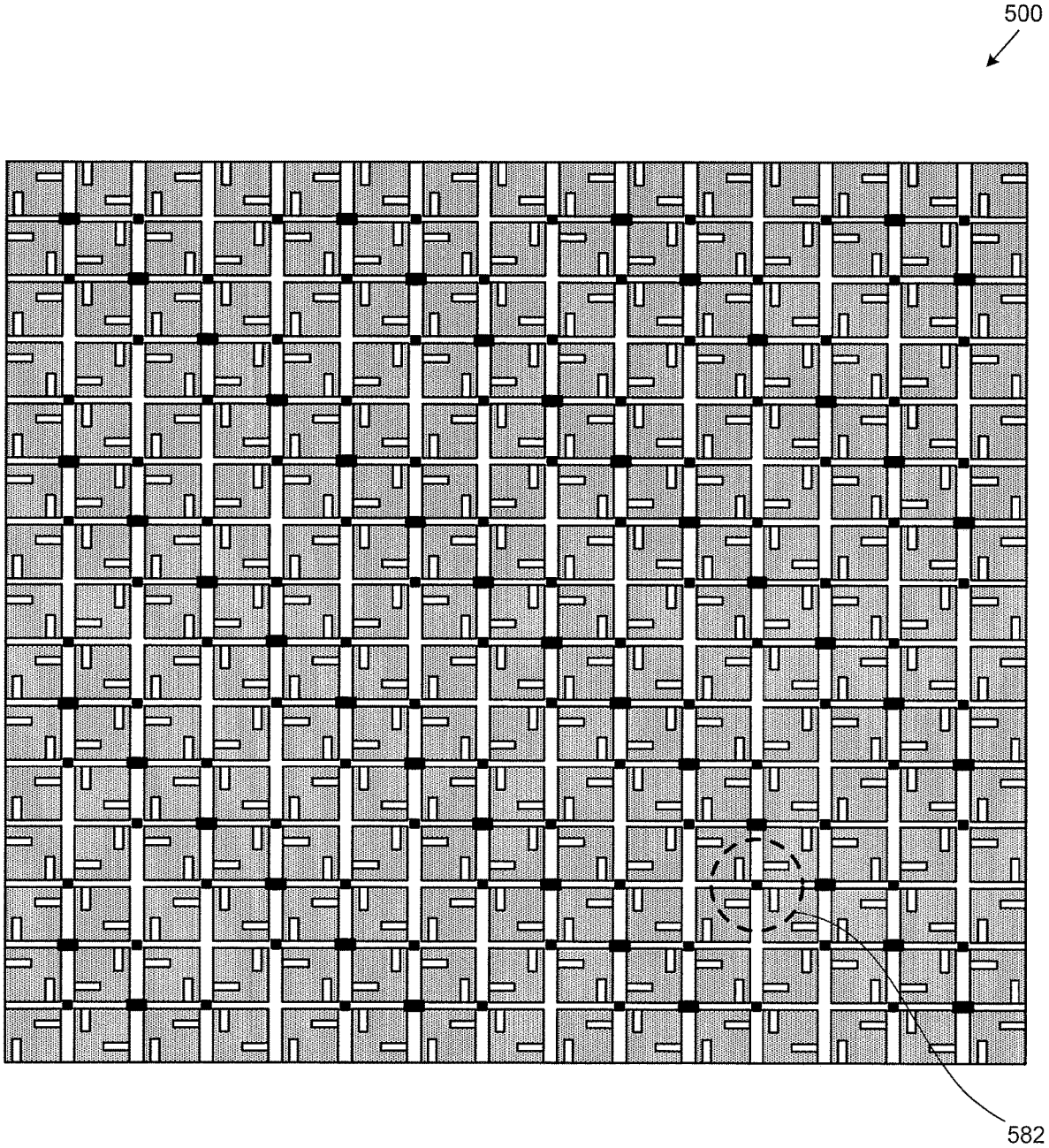
FIG. 5 illustrates a top view of a portion of an exemplary phased array antenna panel according to one implementation of the present application.

FIG. 5 illustrates a top view of a portion of an exemplary phased array antenna panel according to one implementation of the present application. FIG. 5 illustrates a large-scale implementation of the present application. Numerous antennas, RF front end chips, their corresponding probes, and combiner RF chips are arranged on phased array antenna panel 500. Dashed circle 582 in FIG. 5 may correspond to dashed circle 382 in FIG. 3A, which encloses probes 314*e*-H, 314*f*-V, 314*g*-H, and 314*h*-V, or may correspond to dashed circle 482 in FIG. 4A, which encloses probes 414*e*-H, 414*f*-V, 414*g*-H, and 414*h*-V. In one example, phased array antenna panel 500 may be a substantially square module having dimensions of eight inches by eight inches. In other implementations, phased array antenna panel module may have any other shape or dimensions. The various implementations and examples of RF front end chips, combiner RF chips, antennas, electrical connectors, probes, and distances in relation to any elements discussed in FIG. 3 or 4 may also apply to the large-scale implementation shown in phased array antenna panel 500 in FIG. 5.

Thus, various implementations of the present application result in reduced passive loss in the phased array antenna panel without increasing cost, size, and complexity of the phased array antennal panel. From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A phased array antenna panel, comprising:

a first radio frequency (RF) front end chip between a first plurality of antennas, wherein said first RF front end chip is configured to:

receive first input signals from said first plurality of antennas, and produce a first phase-shifted output signal based on a first phase shift of said first input signals;

a second RF front end chip between a second plurality of antennas, wherein said second RF front end chip is configured to:

receive second input signals from said second plurality of antennas, and produce a second phase-shifted output signal based on a second phase shift of said second input signals; and a combiner RF chip configured to:

receive said first phase-shifted output signal and said second phase-shifted output signal, combine a first power of said first phase-shifted output signal and a second power of said second phase-shifted output signal, and produce a power combined output signal based on said combination of said first power signal and said second power signal.

2. The phased array antenna panel of claim 1, wherein said combiner RF chip comprises a lumped-element power combiner.

3. The phased array antenna panel of claim 2, wherein said lumped-element power combiner comprises at least one of an on-chip capacitor or an inductor.

4. The phased array antenna panel of claim 1, wherein said first phase-shifted output signal and said second phase-shifted output signal are fed into respective input buffers in said combiner RF chip.

5. The phased array antenna panel of claim 1, wherein said combiner RF chip includes an output buffer, and wherein said output buffer is configured to generate a buffered power combined output signal based on said power combined output signal.

6. The phased array antenna panel of claim 1, wherein said combiner RF chip is substantially centered between said first RF front end chip and said second RF front end chip.

7. The phased array antenna panel of claim 1, further comprising a master chip, wherein said master chip is configured to:

provide a first phase shift signal to said first plurality of antennas via said first RF front end chip, and provide a second phase shift signal to said second plurality of antennas via said second RF front end chip.

8. The phased array antenna panel of claim 1, further comprising a master chip, wherein said master chip is further configured to:

provide a first amplitude control signal to said first plurality of antennas via said first RF front end chip, and provide a second amplitude control signal to said second plurality of antennas via said second RF front end chip.

9. A phased array antenna panel, comprising:

a first radio frequency (RF) front end chip between a first plurality of antennas, wherein said first RF front end chip is configured to:

receive first input signals from said first plurality of antennas, and produce a first phase-shifted output signal based on a first phase shift of said first input signals;

a second RF front end chip between a second plurality of antennas, wherein said second RF front end chip is configured to:

receive second input signals from said second plurality of antennas, and produce a second phase-shifted output signal based on a second phase shift of said second input signals;

a power combiner on a substrate of said phased array antenna panel, wherein said power combiner comprises microstrips, and wherein said microstrips are configured to:

receive said first phase-shifted output signal and said second phase-shifted output signal, and output a power combined output signal based on said first phase-shifted output signal and said second phase-shifted output signal; and a combiner RF chip configured to receive said power combined output signal.

10. The phased array antenna panel of claim 9, wherein said combiner RF chip is further configured to produce a buffered power combined output signal based on said power combined output signal.

11. The phased array antenna panel of claim 9, wherein said power combined output signal is fed into an input buffer in said combiner RF chip.

12. The phased array antenna panel of claim 9, wherein each antenna of said first plurality of antennas and said second plurality of antennas comprises vertically polarized probe and horizontally polarized probe.

13. The phased array antenna panel of claim 9, wherein said combiner RF chip is substantially centered between said first RF front end chip and said second RF front end chip.

14. The phased array antenna panel of claim 9, further comprising a master chip, wherein said master chip is configured to:

provide a first phase shift signal to said first plurality of antennas via said first RF front end chip, and provide a second phase shift signal to said second plurality of antennas via said second RF front end chip.

15. The phased array antenna panel of claim 9, further comprising a master chip, wherein said master chip is further configured to:

provide a first amplitude control signal to said first plurality of antennas via said first RF front end chip, and provide a second amplitude control signal to said second plurality of antennas via said second RF front end chip.

16. A phased array antenna panel, comprising:

a first radio frequency (RF) front end chip between a first plurality of antennas, wherein said first RF front end chip is configured to:

receive first input signals from said first plurality of antennas, and produce a first amplified output signal based on a first amplification of said first input signals;

a second RF front end chip between a second plurality of antennas, wherein said second RF front end chip is configured to:

receive second input signals from said second plurality of antennas, and produce a second amplified output signal based on a second amplification of said second input signals; and a combiner RF chip configured to:

receive said first amplified output signal and said second amplified output signal, combine a first power of said first amplified output signal and a second power of said second amplified output signal, and produce a power combined output signal based on said combination of said first power signal and said second power signal.

* * * * *